US008356420B2

(12) United States Patent
Morrison et al.

(10) Patent No.: US 8,356,420 B2
(45) Date of Patent: Jan. 22, 2013

(54) ADJUSTABLE DIVIDER/HOPPER FOR A GRAIN TOWER DRYER

(75) Inventors: David Morrison, Carlinville, IL (US); John M. Frankovich, Decatur, IL (US)

(73) Assignee: The GSI Group, LLC, Assumption, IL (US)

( * ) Notice: Subject to any disclaimer, the term of this patent is extended or adjusted under 35 U.S.C. 154(b) by 513 days.

(21) Appl. No.: 12/719,125

(22) Filed: Mar. 8, 2010

(65) Prior Publication Data

US 2010/0223800 A1 Sep. 9, 2010

Related U.S. Application Data

(60) Provisional application No. 61/158,602, filed on Mar. 9, 2009.

(51) Int. Cl.
*F26B 3/14* (2006.01)

(52) U.S. Cl. ..... 34/65; 34/138; 34/171; 34/232; 250/424; 209/134; 219/697; 423/210

(58) Field of Classification Search ..... 34/65, 90, 34/68, 138, 140, 171, 181, 182, 232, 233, 34/210, 218, 174; 250/423 R, 423 P, 424; 219/697; 209/133, 134, 143; 423/210, 245.1, 423/245.3

See application file for complete search history.

(56) References Cited

U.S. PATENT DOCUMENTS

| | | | | |
|---|---|---|---|---|
| 2,548,262 | A * | 4/1951 | Hintz | 34/171 |
| 2,654,590 | A * | 10/1953 | Molenaar | 432/69 |
| 3,053,522 | A * | 9/1962 | Applegate | 432/45 |
| 3,751,824 | A * | 8/1973 | Kyle | 34/167 |
| 3,896,562 | A | 7/1975 | Zimmerman | |
| 4,139,952 | A * | 2/1979 | Stanfield | 34/380 |
| 4,149,844 | A | 4/1979 | Noyes | |
| 4,249,891 | A | 2/1981 | Noyes et al. | |
| 4,404,756 | A * | 9/1983 | Noyes | 34/65 |
| 4,423,557 | A | 1/1984 | Westelaken | |
| 4,914,834 | A * | 4/1990 | Sime | 34/169 |
| 5,544,423 | A * | 8/1996 | Westelaken | 34/174 |
| 5,860,221 | A * | 1/1999 | Morrison et al. | 34/64 |
| 5,893,218 | A * | 4/1999 | Hunter et al. | 34/492 |
| 5,992,044 | A * | 11/1999 | Hanig | 34/434 |
| 6,035,544 | A * | 3/2000 | Morrison et al. | 34/167 |
| 6,098,305 | A * | 8/2000 | Watson et al. | 34/167 |
| 6,158,143 | A * | 12/2000 | Da Cunha | 34/167 |
| 6,202,319 | B1 * | 3/2001 | Bening | 34/165 |
| 6,311,411 | B1 * | 11/2001 | Clark | 34/507 |
| 6,374,510 | B1 * | 4/2002 | Geissbuehler et al. | 34/232 |
| 6,834,442 | B1 * | 12/2004 | Bloemendaal | 34/166 |
| 7,188,436 | B2 * | 3/2007 | Stock et al. | 34/588 |
| 7,568,297 | B2 * | 8/2009 | Pierson et al. | 34/218 |
| 2008/0201980 | A1 * | 8/2008 | Bullinger et al. | 34/493 |
| 2010/0223800 | A1 * | 9/2010 | Morrison et al. | 34/65 |
| 2012/0067789 | A1 * | 3/2012 | Bullinger et al. | 209/133 |

FOREIGN PATENT DOCUMENTS

| | | | |
|---|---|---|---|
| EP | 250297 | A2 * | 12/1987 |
| FR | 2603165 | A1 * | 3/1988 |

(Continued)

*Primary Examiner* — Stephen M. Gravini
(74) *Attorney, Agent, or Firm* — Polster Lieder Woodruff & Lucchesi, L.C.

(57) ABSTRACT

A combined plenum divider/hopper is provided for a grain drying tower. The divider/hopper is positioned in the drying tower proximate the heater for the drying tower and is operable to adjust the ratio of the length of the heating portion of the plenum to the length of the cooling portion of the plenum.

15 Claims, 8 Drawing Sheets

FOREIGN PATENT DOCUMENTS

| | | | | |
|---|---|---|---|---|
| GB | 2405192 | A | * | 2/2005 |
| JP | 10019467 | A | * | 1/1998 |
| JP | 2002228355 | A | * | 8/2002 |
| WO | WO 2009048938 | A1 | * | 4/2009 |

* cited by examiner

ADJUSTABLE DIVIDER/HOPPER FOR A GRAIN TOWER DRYER

CROSS-REFERENCE TO RELATED APPLICATIONS

This application is a non-provisional of U.S. App. No. 61/158,062 filed Mar. 9, 2009, entitled "Adjustable Divider Hopper For A Grain Tower Dryer", and which is incorporated herein by reference.

STATEMENT REGARDING FEDERALLY SPONSORED RESEARCH OR DEVELOPMENT

Not Applicable.

BACKGROUND

This application relates to tower grain dryers, and, in particular to a tower dryer in which the function of plenum adjustment ratio and divider/hopper is combined in a single unit.

A grain tower dryer typically comprises a central plenum defined by a porous (or air pervious) wall. The tower also includes an outer porous (or air pervious) wall spaced from the plenum wall. The plenum wall and outer wall define an annular column through which grain to be dried fall. A heater/blower is typically positioned within the plenum. The heater/blower draws cool air in through a bottom portion of the grain column and expels heated air out through an upper portion of the grain column. Hence, the grain falls through an upper heating section (where the grain is dried) into a lower cooler section (where the grain is cooled).

On occasion, it is desirable to change the ratio of the length of the heating section to the length of the cooling section. Hence, plenum dividers have been devised. One example of a plenum divider is shown in U.S. Pat. No. 4,249,891. As set forth in this patent, the plenum divider comprises two or more pivotal doors which are placed in the plenum and each of which rotates between a horizontal closed position and an open position. When one door is in the horizontal closed position, all doors above the closed door are opened. The closed door defines a floor for the heating section, and thus separates the heating section from the cooling section. By selecting which doors are opened and closed, the ratio of the length of the heating section to the length of the cooling section can be altered.

As the grain falls through the grain column, particulate matter can pass through the plenum wall to drop down through the plenum (as opposed to the grain column). Divider/hoppers have been installed in some grain drying towers without plenum dividers. Examples of such a divider/hopper is shown in U.S. Pat. No. 3,896,562. Similar divider/hoppers are included in some of the F-Series Farm Fan Tower Dryers available from ffi, inc. and in some of the T-Series tower dryers available from The GSI Group. However, to our knowledge, such hoppers have not been installed in dryers with plenum dividers. As can be appreciated, the use of the standard doors, such as disclosed in the above noted patents, will simply provide different flat surfaces on which the particulate matter can collect. Thus, we are not aware of any tower dryer that includes both a divider/hopper and a plenum wherein the ratio of the length of the heating portion of the plenum to the length of the cooling portion of the plenum can be adjusted.

BRIEF SUMMARY

Briefly, a grain drying tower is comprised of a heater, a plenum wall surrounding the heater, an inner wall surrounding the plenum wall and an outer wall surrounding the inner wall. The inner and outer walls, in combination, defining an annular grain drying path. The tower includes an inlet at the top of the tower which directs grain to the grain drying path. The grain passes along the drying path, to exit the tower at an outlet at the bottom of the tower. The inner and outer walls are perforated so that heated air can pass through the drying path to dry the grain as it falls along the drying path. The drying tower is also provided with a combined plenum divider/hopper which can be operated to adjust the ratio of the length of the heating portion of the plenum to the length of the cooling portion of the plenum.

The combined plenum divider/hopper comprises a sloping upper surface having an upper end and a lower end and a sloping lower surface having an upper end and a lower end. The two surfaces each define a plurality of windows. The windows of the lower surface are spaced vertically below and are aligned with the windows of the upper surface. The upper end of the lower surface is adjacent the lower end of the upper surface, such that the upper and lower surfaces, in combination, define a generally arrow-shaped assembly in vertical cross-section. In an illustrative embodiment, the "arrow" points inwardly, i.e., the adjacent ends of the upper and lower surfaces are proximate the inner wall.

The plenum divider/hopper further includes a plurality of panels, there being at least one panel associated with each pair of aligned windows in the upper and lower surfaces. The panels are each movable between a first position in which the upper surface windows are closed and the lower surface windows are opened and a second position in which the upper surface windows are opened and the lower surface windows are closed. An upper gap is formed between the upper surface and one of the plenum wall and the inner wall and a lower gap is formed between the lower surface and the other of the plenum wall and the inner wall, such that the grain can flow past the upper or lower plate when the windows of the respective plate are closed.

The divider/hopper can include a single panel for each aligned pair of windows, or the divider/hopper can include a separate panel for each window in a pair of vertically aligned windows. In the version which includes a separate panel for each window of a pair of aligned windows, the plenum divider/hopper can include a link between the panel for the lower surface window and the panel for the upper surface window such that the panels will move together. Alternatively, the two panels for a pair of aligned windows can be independently operable. In this instance, the divider/hopper can be in three different modes: (1) upper plate windows open and lower plate windows closed; (2) upper plate windows closed and lower plate windows opened; and (3) upper plate windows closed and lower plate windows closed.

In accordance with one aspect of the divider/hopper, the upper and lower surfaces are each defined by a plurality of plates. In accordance with this aspect, the divider/hopper further comprises a plurality of radially extending dividers; and the plates are mounted along their side edges to the dividers.

In accordance with a further aspect of the divider/hoper, the divider/hopper includes means for moving the panels between their first and second positions. These means can comprise rods, links, pulley systems, gear systems, or combinations thereof.

BRIEF DESCRIPTION OF THE SEVERAL VIEWS OF THE DRAWINGS

Corresponding reference numerals will be used throughout the several figures of the drawings.

DETAILED DESCRIPTION

Figure 1:
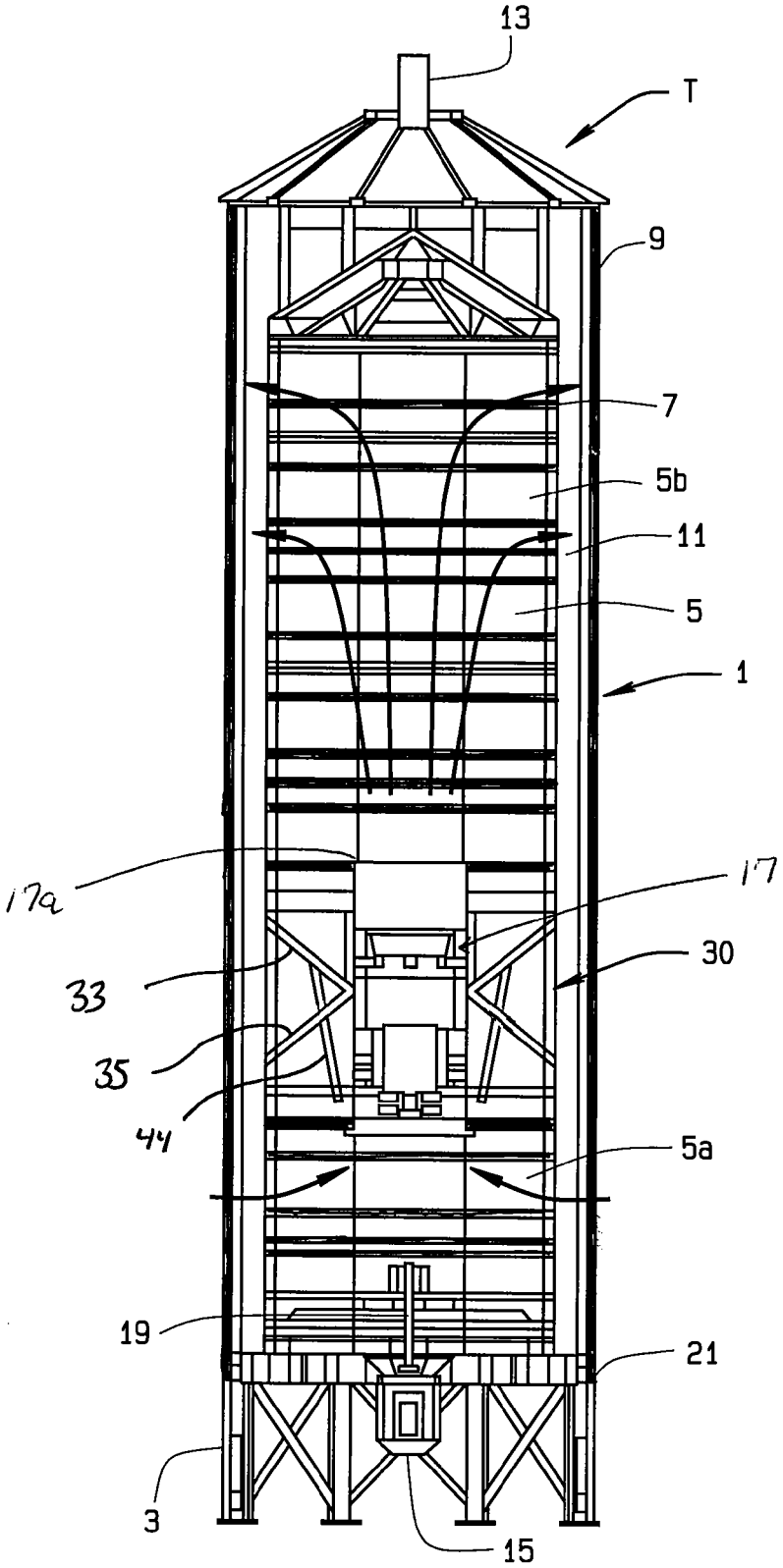
FIG. 1 is a view of a tower grain dryer partially cut away.
Figure 2:
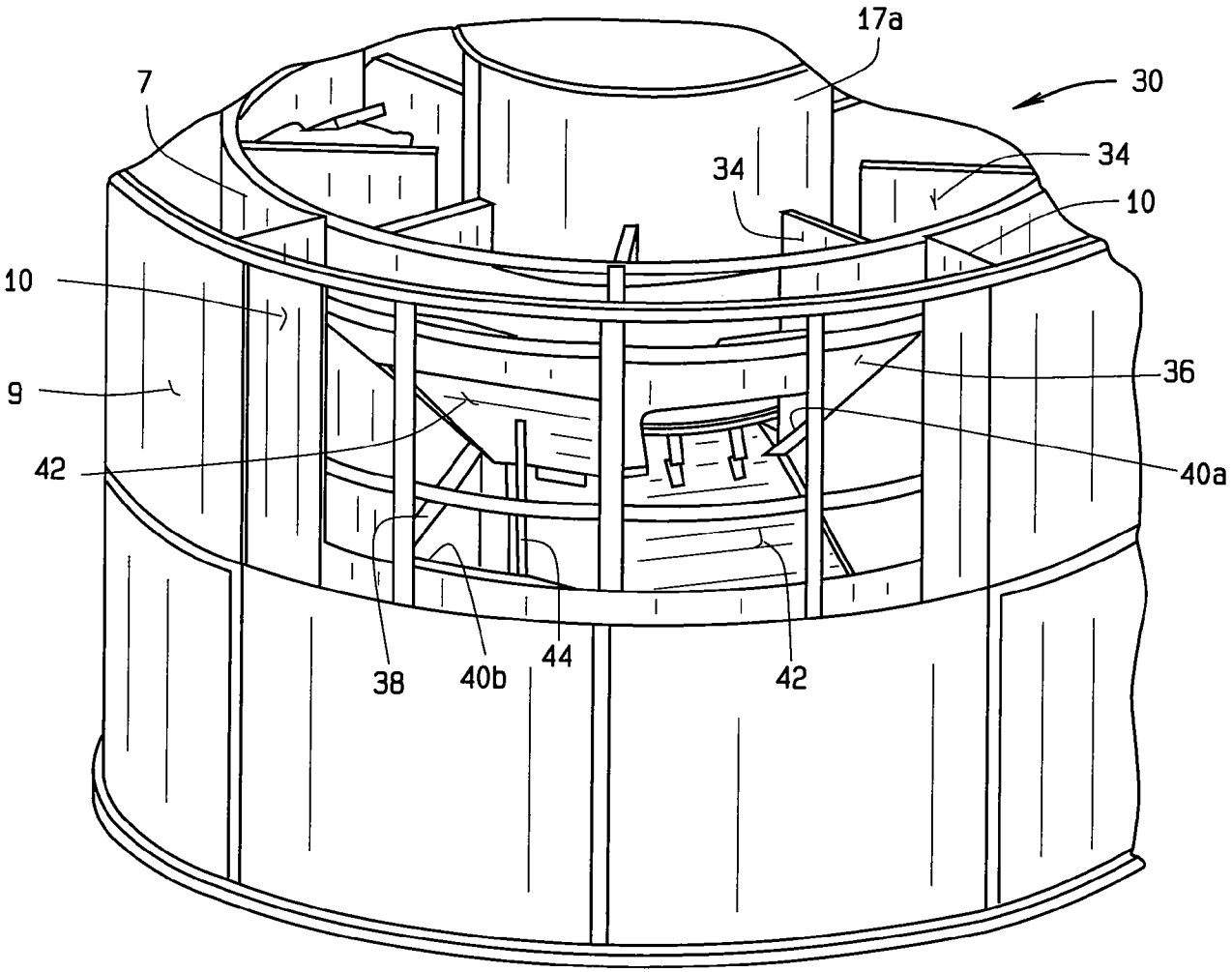
FIG. 2 is a perspective view of a combined plenum divider and hopper
Figure 3:
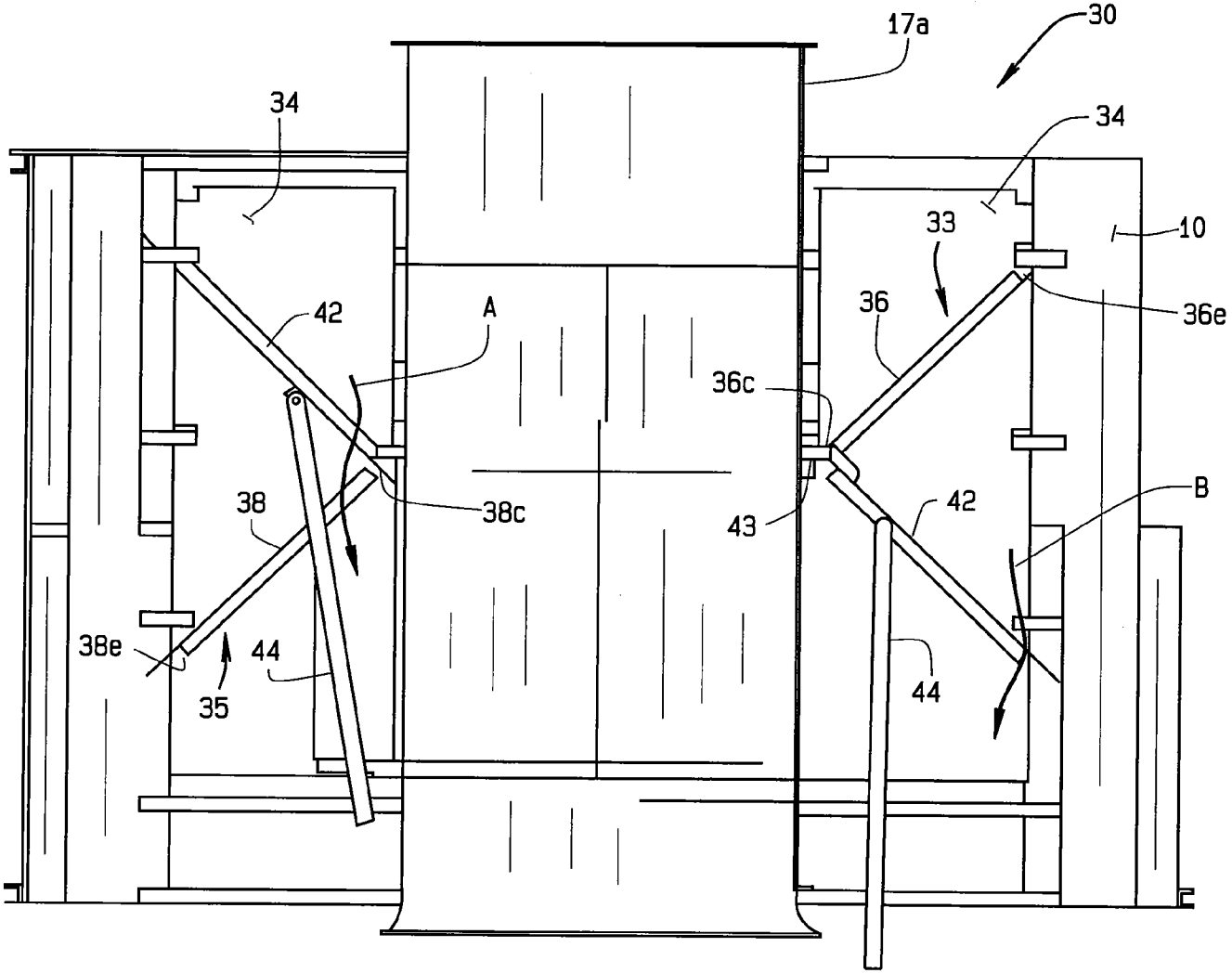
FIG. 3 is a cross-sectional view of the combined plenum divider and hopper.

The following detailed description illustrates the claimed invention by way of example and not by way of limitation. This description will clearly enable one skilled in the art to make and use the claimed invention, and describes several embodiments, adaptations, variations, alternatives and uses of the invention, including what we presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A cylindrical tower grain dryer T is shown in partial cross-section in FIG. 1. The tower dryer T comprises a vertical grain drying tower 1 which may, for example, be fifty (50) feet (15 m) or more in height. The tower has a base 3 of suitable structural steel members mounted in a suitable foundation (not shown). A plenum 5 is disposed within the grain dryer. The plenum 5 is defined by a generally cylindrical porous plenum wall 7, which wall is also referred to as an inner wall. The tower 1 has an outer cylindrical dryer wall 9 of porous (perforate) construction surrounding plenum wall 7 and spaced outwardly there from. The tower can include spacers 10 which separate the outer wall 9 from the plenum wall 7. The inner and outer walls 7 and 9 define a vertical, annular grain drying path 11 (sometimes referred to as a grain column). While the spacing between the porous walls 7 and 9 may vary, typically the spacing between these walls is approximately 12 inches (30.98 cm). Grain may be supplied to the grain drying path 11 by means of a grain inlet 13 at the top of the tower 1 and dried grain maybe discharged from the tower dryer by means of a grain discharge outlet 15 at the lower end of the dryer.

A heater/blower assembly 17 is provided within the grain dryer for drawing ambient air through the grain path 11 in the lower reaches of the tower and, if demanded, for heating the air, and for discharging the heated air under pressure into plenum 5. In this manner, the air discharged from heater/blower 17 is distributed substantially uniformly within the plenum and is forced to flow through the porous plenum wall 7, through the grain in grain path 11, and is exhausted through the porous outer wall tower 9 to the atmosphere thereby drying the grain in the grain path and carrying moisture from the grain to the atmosphere. As can be appreciated, the air that is drawn in through the lower reaches of the tower will cool the grain in the grain path 11. Hence, the portion of the tower at or below the heater/blower comprises a cooling section 5*a* and the potion of the tower at or above the heater/blower comprises a heating section 5*b*. While the heater/blower 17 is shown in FIG. 1 to be located within tower 1, it will be understood that within the broader aspects of this invention that the heater/blower may be located outside the tower in close proximity thereto and air from the heater/blower may be ducted into plenum 5. Typically, fuel for heater/blower assembly 17 is supplied by gas fuel supply lines 19 and operation of the heater/blower assembly and overall operation of tower dryer T is controlled by a computer control housed in a control panel 21.

The tower 1 is provided with a combined plenum divider/hopper 30 which is positioned within the tower plenum 5. As shown in FIG. 1, the combined plenum divider/hopper 30 is positioned about the blower/heater assembly 17, with the output of the blower/heater assembly 17 being above the combined plenum divider/hopper 30. The combined plenum divider/hopper 30 divides the plenum 5 into the lower cooling section 5*a* and the upper heating section 5*b*.

Figure 4:
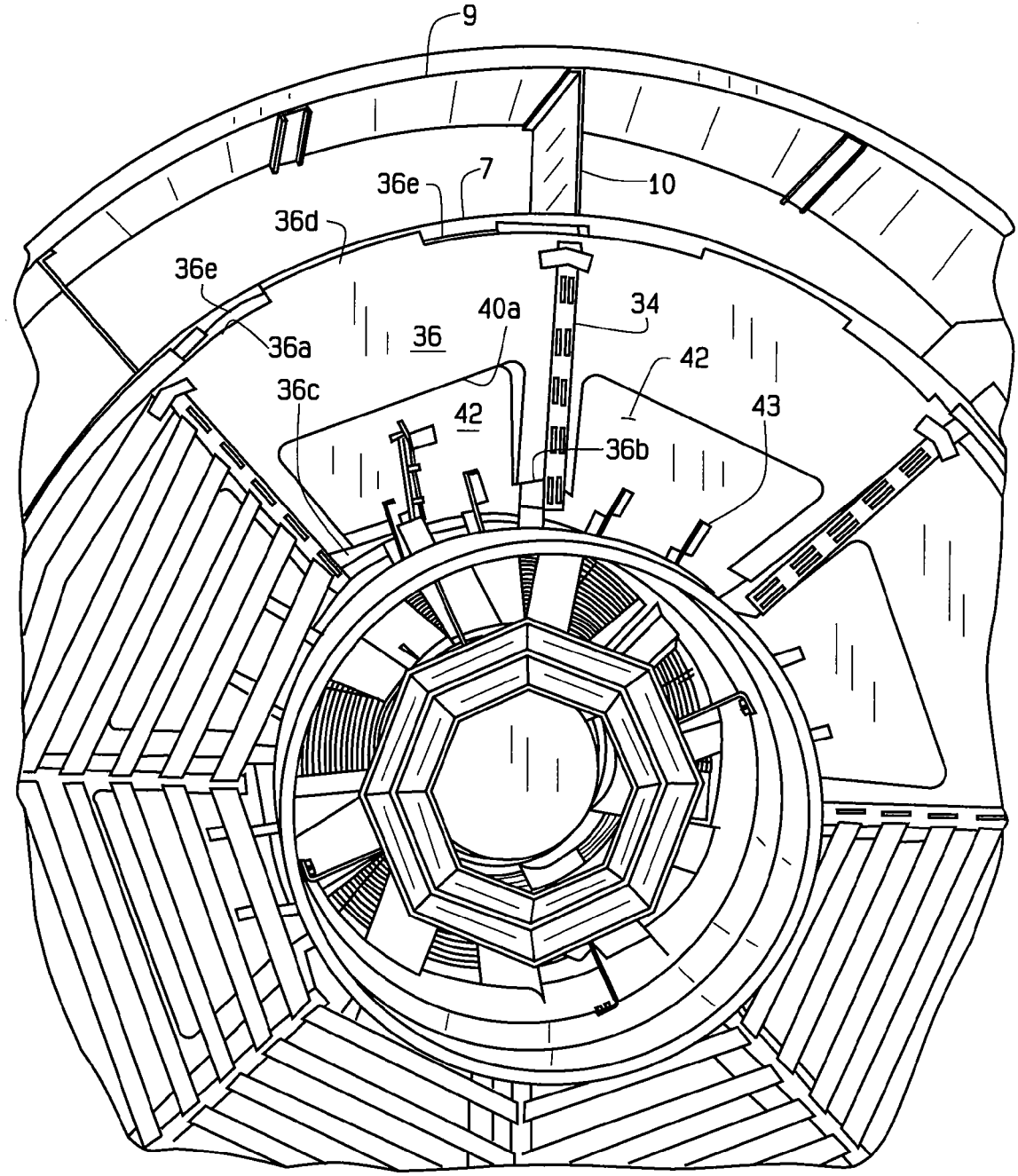
FIG. 4 is an enlarged, fragmentary top plan view of the divider/hopper.
Figure 5:
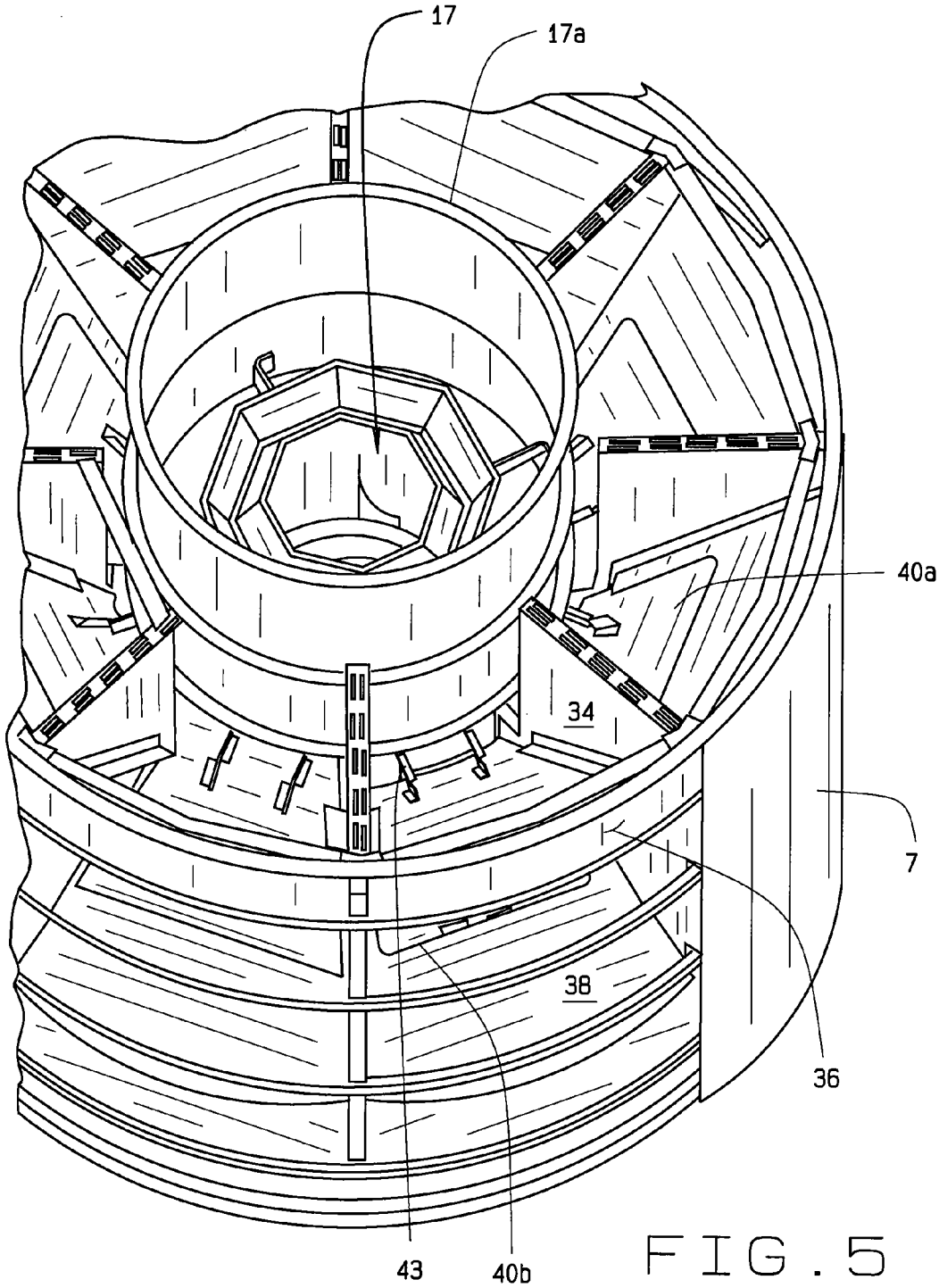
FIG. 5 is a top fragmentary perspective view of the divider/hopper with a portion of the plenum wall removed to better show the plates of the divider/hopper.
Figure 6:
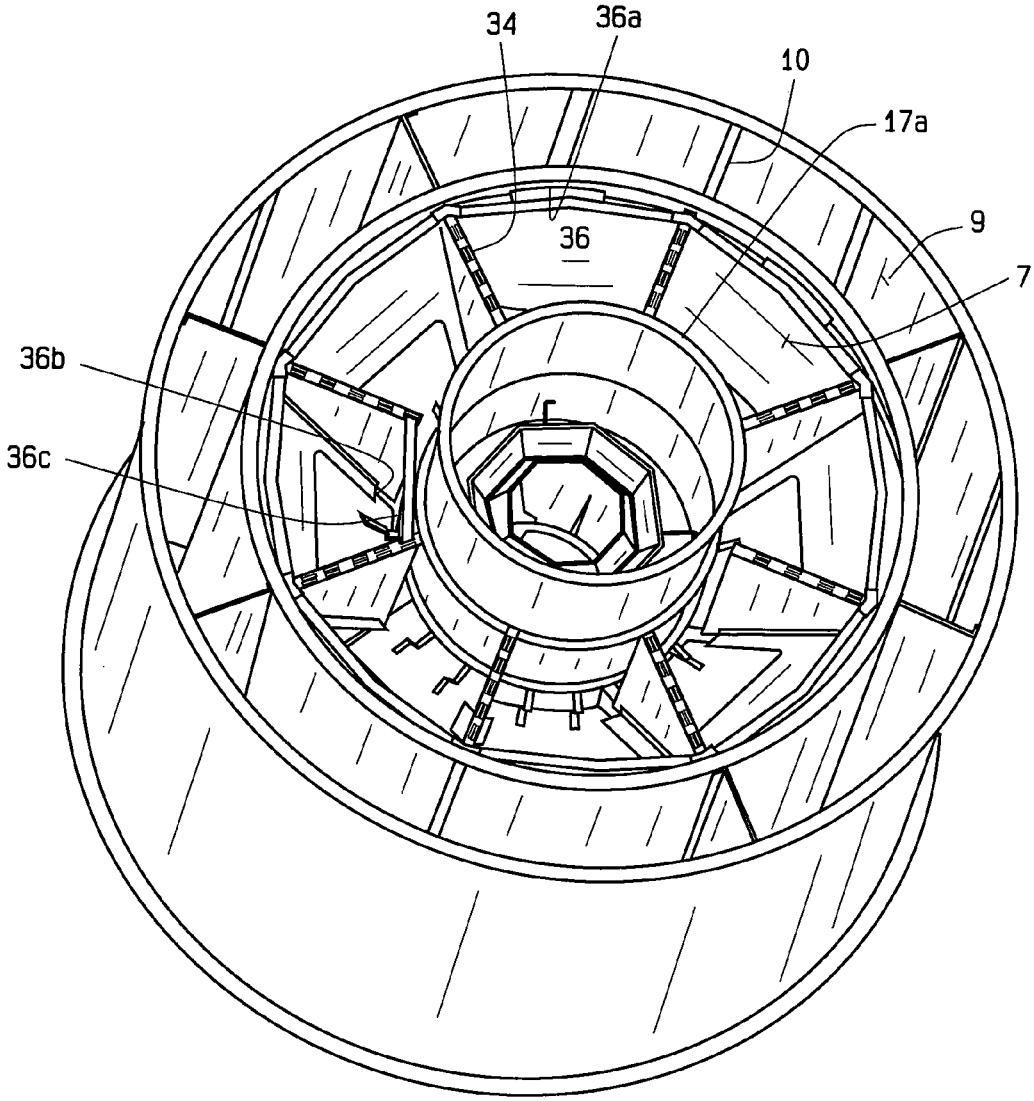
FIG. 6 is a top perspective view of the divider/hopper.

Turning to FIGS. 2-7, the combined plenum divider/hopper 30 comprises an inwardly sloping upper surface 33 and an outwardly sloping lower surface 35 which extend generally between the wall 17*a* of the heater 17 and the plenum wall 7. The upper surface 33 is comprised of a plurality of upper plates 36 and the lower surface 35 is comprised of a plurality of lower plates 38. The upper plates 36 slope downwardly in inwardly from plenum wall 7 to the blower/heater assembly wall 17*a*. As seen in FIG. 4, the upper plates 36 have an outer edge 36*a* and an inner edge 36*b*. The upper plate inner edges 36*b* are spaced from the blower wall 17*a*. Thus an upper inner gap 36*c* is formed between the upper inner edges 36*b* and the blower/heater assembly wall 17*a* (and hence, between an inner edge of the upper surface 33 and the blower/heater assembly wall).

Figure 7:
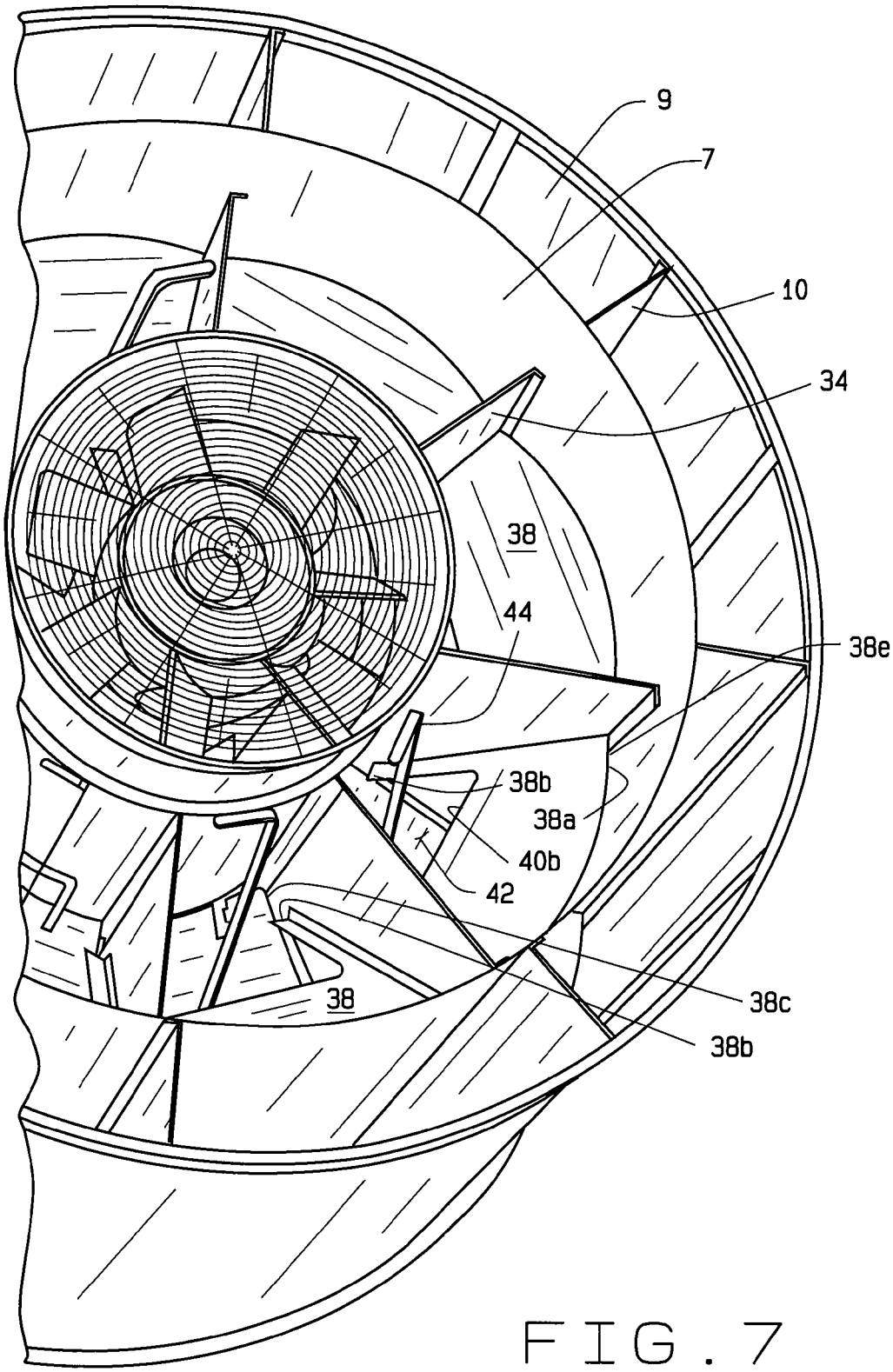
FIG. 7 is a fragmentary bottom plan view of the divider/hopper.

The lower plates 38 slope downwardly and outwardly from the blower/heater assembly wall 17*a* to the plenum wall 7. With reference to FIG. 7, the lower plates 38 each include outer edge 38*a* and an inner edge 38*b*. The lower plate 38 inner edges 38*b*, like the upper plate inner edges, are spaced from blower/heater assembly wall 17*a*. A lower inner gap 38*c* is thus formed between the lower plate 36 (and thus the lower surface 35) and the blower/heater assembly wall 17*a*. The lower plate outer edge 38*a* is generally actuate and is spaced from the plenum wall 7 along the length of the lower plate outer edge 38*a*. Thus, a lower outer gap 38*e* is formed between the lower plate 38 (and hence the lower surface 35) and the plenum wall 7.

The upper and lower plates 36, 38 are generally flat, each defining a section of a circle. As seen in the Figures, the divider/hopper 30 includes eight upper plates and eight lower plates. Adjacent upper plates 36 and adjacent lower plates 38 are separated by (and mounted to) radially extending, vertical divider walls 34 along their side edges. Thus, the divider/hopper 30 is effectively divided into eight sections. The inner edges 36*b*, 38*b* of the upper and lower plates 36, 38 are closer to each other than their respective outer edges 36*a*, 38*a*. Hence, the upper plate 36 and lower plate 38 in combination, generally define an outwardly opening V (i.e., they define a "<" shape), in which the apex has been removed or is opened. The upper plates 36, in combination, define an upright funnel and the lower plates 38, in combination, define an upside-down or inverted funnel.

The plates 36 and 38 are each provided with a plurality of windows 40*a,b*, with the windows 40*a* in the upper plates 36 being vertically above and aligned with the windows 40*b* in the lower plates 38. The windows 40*a,b* are formed as cutouts which extend from the inner edges 36*b*, 38*b* toward the outer edges 36*a*, 38*a* of the plates 36, 38.

A plurality of panels 42 are pivotally mounted to the blower wall 17*a* between the upper and lower plates 36, 38, and are preferably mounted proximate the "apex" of the "<" defined by plates 36, 38. There is a panel 42 positioned between, and in alignment with, each set of windows 40*a,b*. Thus, there is one panel 42 for each set of windows 40*a,b* and in each section of the divider/hopper 30. In the illustrative embodiment shown, there are eight panels 42. The panels 42 are each pivotable between an upper position in which the window 40*a* in the upper plate 36 is closed and a lower position in which the window 40*b* in the lower plate 38 is closed. The panel 42 is positioned relative to the plates 36, 38 such that when the panel is in the upper position, a gap is maintained between the upper plate 36 (and hence the upper surface 33) and the blower wall 17*a*. Thus, the upper inner gap extends substantially the length of the inner edge 36*b* of the upper plate 36. The panels 42 are shown to be mounted by means of brackets 43, but any desired means of pivotally mounting the panels to the blower wall 17*a* can be employed. The panels 42 can be moved using control rods 44 which are pivotally connected at an upper end to a lower surface of the panels 42. In some of the Figures, panels 42 are shown in both the raised and lowered position. However, it will be appreciated that in actual use, all the panels will be in the same position.

The panels 42 are shown to be moved between their opened and closed positions by means of control rods 44. The push rods can be operated manually, or can be operated by means of a motor. For example, a rack and pinion system could be used to operate the push rods. The push rods 44 shown in the drawings comprise upper and lower sections which are pivotally connected at a joint, with the lower rod section being pivotally mounted to a bracket. Thus, by moving the lower end of the lower rod section horizontally, the upper end of the upper rod section will be moved vertically, thereby moving the plate between its two positions. Any other desired means of moving the panels could be used. For example, a rope and pulley system could be used, which could potentially allow for a single rope to be pulled to move all the panels 42 at the same time between their respective positions. Alternatively, hydraulic or pneumatic systems could be used to move the panels between their respective positions. In such alternative systems, the hydraulic or pneumatic system would be operatively connected to the push rods to be operable to move the panels to open and close the windows. If the panels are moved by means of a motor or a hydraulic or pneumatic system, a controller can be provided which controls the movement of the panels.

The plates 36, 38 of the surfaces 33, 35 define the floors between the heating and cooling sections of the plenum 5. When the panels 42 are in the raised position (such that the windows 40*a* in the upper plate 36 are closed), the upper surface 33 will define the floor of the heating section 5*b*. However, when the panels 42 are in the lowered position, the upper plate windows 40*a* are opened and the lower plate windows 40*b* are closed. Hence, the lower surface 35 will define the floor of the plenum heating section 5*b*. Thus, the size of the plenum heating section is increased (and the size of the cooling section is decreased) by moving the panels 42 from the raised to the lowered position. In the embodiment shown, the length of travel of the outer ends of the panel 42 can be as much as 42". In a tower that is about 40'-80' tall and 12' wide, the change in the heating to cooling ratio can be significant.

With just one divider/hopper assembly 30, the panels 42 will be moved only between the upper and lower positions. However, by increasing the number of sloped plates, the ratio of the length of the heating section 5*b* to the length of the cooling section 5*a* can be altered even further. Thus, for example, two assemblies 30 can be positioned in the plenum 5. For the panels 42 of the lower of the two assemblies to have an effect, the panels 42 of the upper of the two assemblies would be placed in a neutral position, such that air could flow through the windows 40*a,b* in the plates 36 and 38 of the upper assembly 30. Two divider/hopper assemblies would provide for four surfaces, and thus four possible floors for the heating section. Alternatively, a third surface (comprised of plates) could be provided which would be above the upper surface 33 or below the lower surface 35 to define a third surface. The plates for the third surface would need to be provided with their own panels to open and close the windows in this third floor.

Figure 8:
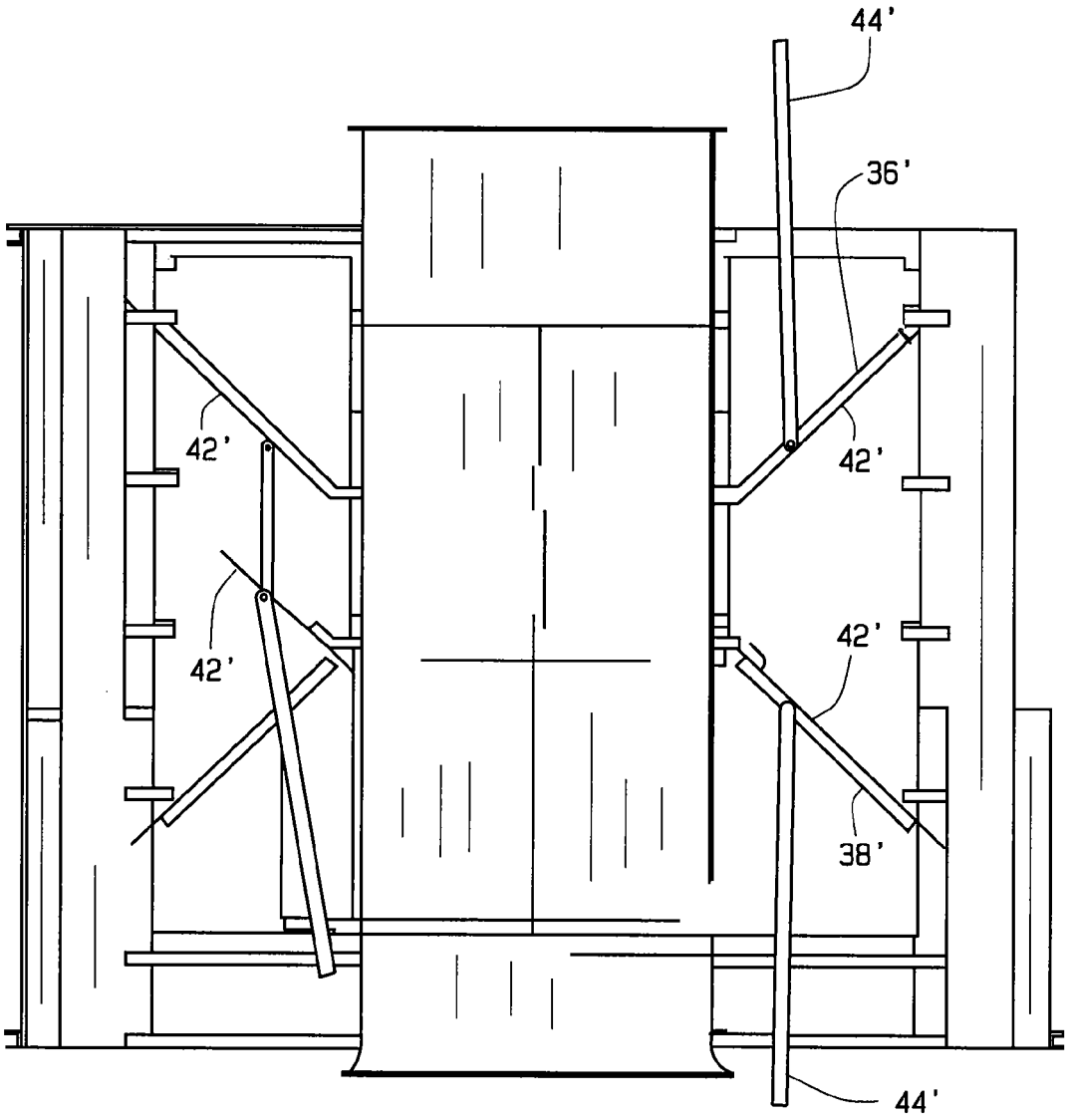
FIG. 8 is a cross-sectional view showing two variations of an alternative embodiment of the divider/hopper having two panels positioned between the upper and lower surfaces of the divider/hopper. On the left side the two panels are linked together and on the right side, the panels are independently operated.

In a further variation, as seen in FIG. 8, two panels 42' could be positioned between each upper and lower plates 36', 38' pair. The panels 42' would thus comprise an upper panel (which would open and close the upper plate window) and a lower panel (which would open and close the lower plate window). Hence, each plate would be provided with its own panel, and the upper and lower panels could be linked or otherwise operated, such that when one is moved to close its respective window, the other is moved to open its respective window. In the situation where there are three or more plates (to define three or more heating to cooling ratios), a separate panel would be provided for each window in each plate. Again, the panels 42' can be connected or linked, such as seen on the left side of FIG. 8, such that when, for example, the upper plate windows are opened, the lower plate windows will be closed. Conversely, the panels could be independently operated, such that all the panels on both the upper surface 33 and the lower surface 35 are in their closed positions. As seen on the right side of FIG. 8, the upper and lower panels 42' are each provided with their own control rods 44'. In this case, air flow between the upper and lower surfaces 33,35 would be appreciably reduced to the point where a "steeping" section would be created while the divider/hopper function remains. Steeping allows the grain moisture and temperature to equalize and reduces the shock of sudden cooling as grain moves between the plenum heating section and the plenum cooling section. This is believed to reduce stress cracking of the kernels. The ability to have a steeping section allows for an operator to further customize the drying process.

As noted, the plates 36 and 38 are both sloped; with the plates 36 sloping inwardly and the plates 38 sloping outwardly. Thus, the floor of the plenum heating section 5*a* is a sloped floor, and particulate matter will fall from the higher end of the sloped plate toward the lower end of the sloped plate. Further, as noted above, the upper plates define upper inner gaps 36*c* and the plates define lower outer gaps 38*e*. Hence, when the panel 42 is in the raised position, particulate matter can fall through the upper inner gap 36*c* along the arrow A (on the left side of FIG. 3); and when the panel 42 is in its lower position, particulate matter can fall through the opened window 40*a* of the upper plate 36 to land on the lower plate 38. The particulate matter can then slide or fall toward the lower (outer) end of the plate 38 to the lower outer gap 38*e*, to thereby fall along the arrow B (on the right side of FIG. 3) to the bottom of the plenum 5 where the particulate matter can be collected.

In view of the above, it will be seen that the plenum divider/hopper assembly 30 allows for the ratio of length of the heating section to the length of the cooling section to be altered while at the same time, allowing for particulate matter to fall through to the bottom of the plenum 5 where it can be collected, thereby reducing or avoiding the buildup of the particulate matter on the floor of the plenum heating section.

As various changes could be made in the above constructions without departing from the scope of the invention, it is intended that all matter contained in the above description or shown in the accompanying drawings shall be interpreted as illustrative and not in a limiting sense. Although the upper and lower plates are proximate each other adjacent the blower/heater assembly wall 17*a*, they could be proximate each other adjacent the plenum wall 7, such that the divider/hopper assembly 30 defines an arrow-shape (in vertical cross-section) with an outwardly pointed, rather than an inwardly pointed, apex. Further, although the panels 42 are mounted to the blower/heater assembly wall 17*a* and the dividers 34 are mounted between the blower/heater assembly wall 17*a* and the plenum wall 7, the divider/hopper 30 could be formed as an assembly and include an inner cylinder to which the panels 42 and the dividers 34 are mounted. An outer cylinder or outer rings could surround the outer edge of the panels 42. In another alternative, the upper and lower plates could be continuous, thereby eliminating the need for the dividers 34. In such a case, the upper and lower plates could be curved (as opposed to flat) to define a circle in horizontal cross-section. In this case, the plates would be generally conical. These examples are merely illustrative.

The invention claimed is:

1. A combined plenum divider/hopper for a grain drying tower; the tower comprising a heater, an inner plenum wall surrounding the heater, and an outer wall surrounding the plenum wall; the combined plenum divider/hopper comprising:

a sloping upper surface having an upper end and a lower end and defining a plurality of windows;

a sloping lower surface having an upper end and a lower end defining a plurality of windows; the windows of the lower surface being spaced vertically below and being aligned with the windows of the upper surface; the upper end of said lower surface being adjacent the lower end of said upper surface, such that the upper and lower surfaces, in combination, define a generally arrow-shaped assembly in vertical cross-section; and a plurality of panels pivotally mounted in said divider/hopper; there being at least one panel associated with each pair of aligned windows in the upper and lower surfaces; said panels each being movable between a first position in which the upper surface windows are closed and the lower surface windows are opened and a second position in which the upper surface windows are opened and the lower surface windows are closed.

2. The combined plenum divider/hopper of claim 1 wherein a window in the upper surface and a window in the lower surface define a pair of vertically aligned windows; the divider/hopper comprising a single panel for each pair of vertically aligned windows.

3. The combined plenum divider/hopper of claim 1 wherein a separate panel is provided for each window in said upper and lower surfaces.

4. The combined plenum divider/hopper of claim 3 including a link between the panel for the lower surface window and the panel for the upper surface window, whereby, said panels move together.

5. The combined plenum divider/hopper of claim 3 wherein the lower plate panels and the upper plate panels are independently operable, such that the divider/hopper can be in three different modes: (1) upper plate windows open and lower plate windows closed; (2) upper plate windows closed and lower plate windows opened; and (3) upper plate windows closed and lower plate windows closed.

6. The combined plenum divider/hopper of claim 1 wherein said upper and lower surfaces are each defined by a plurality of plates; said divider/hopper further comprising a plurality of radially extending dividers; said plates being mounted along side edges of said plates to said dividers.

7. The combined plenum divider/hopper of claim 1 including means for moving said panels between their first and second positions.

8. A grain drying tower comprising a heater, an plenum wall surrounding the heater, and an inner wall surrounding the plenum wall and an outer wall surrounding the inner wall; the inner and outer walls, in combination, defining an annular grain drying path; and a combined plenum divider/hopper; the combined plenum divider/hopper being positioned proximate the heater between said plenum wall and said inner wall; the combined plenum divider/hopper comprising:

a sloping upper surface having an upper end and a lower end and defining a plurality of windows; one of said upper end and lower end defining an inner edge and the other of said upper end and lower end defining an outer edge;

a sloping lower surface having an upper end and a lower end defining a plurality of windows; one of said upper end and lower end defining an inner edge and the other of said upper end and lower end defining an outer edge; the windows of the lower surface being spaced vertically below and being aligned with the windows of the upper surface; the upper end of said lower surface being adjacent the lower end of said upper surface, such that the upper and lower surfaces, in combination, define a generally arrow-shaped assembly in vertical cross-section; and a plurality of panels pivotally mounted in said divider/hopper; there being at least one panel associated with each pair of aligned windows in the upper and lower surfaces; said panels each being movable between a first position in which the upper surface windows are closed and the lower surface windows are opened and a second position in which the upper surface windows are opened and the lower surface windows are closed.

9. The grain drying tower of claim 8 wherein the inner edges of the upper and lower surfaces are generally proximate the plenum wall and the outer edges of the upper and lower surfaces are generally proximate the inner wall; wherein an upper gap is formed between the upper surface and one of the plenum wall and the inner wall and a lower gap is formed between the lower surface and the other of the plenum wall and the inner wall.

10. The grain drying tower of claim 8 wherein a window in the upper surface and a window in the lower surface define a pair of vertically aligned windows; the divider/hopper comprising a single panel for each pair of vertically aligned windows.

11. The grain drying tower of claim 8 wherein a separate panel is provided for each window in said upper and lower surfaces.

12. The grain drying tower of claim 11 including a link between the panel for the lower surface window and the panel for the upper surface window, whereby, said panels move together.

13. The grain drying tower of claim 11 wherein the lower plate panels and the upper plate panels are independently operable, such that the divider/hopper can be in three different modes: (1) upper plate windows open and lower plate windows closed; (2) upper plate windows closed and lower plate windows opened; and (3) upper plate windows closed and lower plate windows closed.

14. The grain drying tower of claim 8 wherein said upper and lower surfaces are each defined by a plurality of plates; said divider/hopper further comprising a plurality of radially extending dividers; said plates being mounted along side edges of said plates to said dividers.

15. The combined plenum divider/hopper of claim 8 including means for moving said panels between their first and second positions.

* * * * *